US009951493B2

(12) United States Patent
Heraty

(10) Patent No.: US 9,951,493 B2
(45) Date of Patent: Apr. 24, 2018

(54) PRECAST INTEGRAL POST AND RETAINING WALL AND METHOD FOR INSTALLING SAME

(71) Applicants: UTILITY CONCRETE PRODUCTS, LLC, Morris, IL (US); Thomas Heraty, Morris, IL (US)

(72) Inventor: Thomas Heraty, Morris, IL (US)

(73) Assignee: Utility Concrete Products, LLC, Morris, IL (US)

( * ) Notice: Subject to any disclaimer, the term of this patent is extended or adjusted under 35 U.S.C. 154(b) by 0 days.

(21) Appl. No.: 14/902,815

(22) PCT Filed: Jul. 3, 2014

(86) PCT No.: PCT/US2014/045404

§ 371 (c)(1),
(2) Date: Jan. 4, 2016

(87) PCT Pub. No.: WO2015/003129

PCT Pub. Date: Jan. 8, 2015

(65) Prior Publication Data

US 2016/0177534 A1 Jun. 23, 2016

Related U.S. Application Data

(60) Provisional application No. 61/842,807, filed on Jul. 3, 2013.

(51) Int. Cl.

| | |
|---|---|
| ***E02D 29/02*** | (2006.01) |
| ***E02D 17/20*** | (2006.01) |
| ***E04H 12/22*** | (2006.01) |

(52) U.S. Cl.
CPC ..... *E02D 29/0266* (2013.01); *E02D 17/20* (2013.01); *E02D 29/02* (2013.01); *E02D 29/0225* (2013.01); *E04H 12/2215* (2013.01)

(58) Field of Classification Search
CPC ..... E02D 29/0266; E02D 29/02; E02D 17/20; E02D 29/0225; E04H 12/2215
USPC ..... 405/284, 285, 286, 262
See application file for complete search history.

(56) References Cited

U.S. PATENT DOCUMENTS

| | | | | |
|---|---|---|---|---|
| 2,000,492 A * | 5/1935 | McKeen | E02D 29/02 | 405/262 |
| 3,815,369 A * | 6/1974 | Meredith | E02D 17/04 | 405/285 |
| 4,836,718 A * | 6/1989 | Deaton | E02D 5/20 | 405/262 |
| 4,911,585 A * | 3/1990 | Vidal | E02D 29/0283 | 405/284 |

(Continued)

*Primary Examiner* — Benjamin F Fiorello
*Assistant Examiner* — Carib A Oquendo
(74) *Attorney, Agent, or Firm* — Husch Blackwell LLP; Edward D. Manzo; George S. Pavlik

(57) ABSTRACT

A prefabricated retaining wall structure and method of installing. The structure has a precast concrete face panel and an elongated support column permanently joined to the face panel. The face panel has a top and bottom, opposing end edges and first and second sides with a thickness therebetween. The elongated support column is secured to the face panel between the opposing end edges. The column has first and second ends and an elongated body therebetween and extends along a portion of the first side of the face panel.

2 Claims, 9 Drawing Sheets

(56) References Cited

U.S. PATENT DOCUMENTS

| | | | | | |
|---|---|---|---|---|---|
| 5,050,828 | A * | 9/1991 | Wolff | E04H 12/2215 | 248/156 |
| 5,144,779 | A * | 9/1992 | Vidal | E02D 29/0266 | 405/284 |
| 5,178,493 | A * | 1/1993 | Vidal | E02D 29/0266 | 405/262 |
| 5,218,797 | A * | 6/1993 | Kruse | E01F 8/0017 | 52/169.9 |
| 5,233,810 | A * | 8/1993 | Jennings | E04H 17/168 | 52/474 |
| 5,368,416 | A * | 11/1994 | Cataldo | E01F 8/0011 | 405/258.1 |
| 8,635,833 | B2 * | 1/2014 | Anderson | E02D 29/02 | 52/296 |
| 8,820,722 | B2 * | 9/2014 | Reinert, Sr. | E04H 12/2215 | 256/65.14 |
| 2002/0069602 | A1 * | 6/2002 | Blanchet | E04B 1/04 | 52/600 |
| 2007/0092343 | A1 * | 4/2007 | Cargill | E02D 29/0233 | 405/284 |

* cited by examiner

Fig. 1D
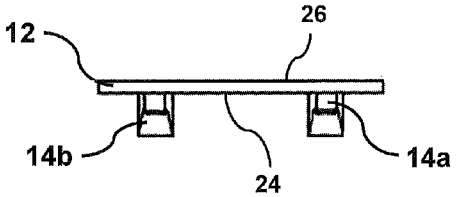
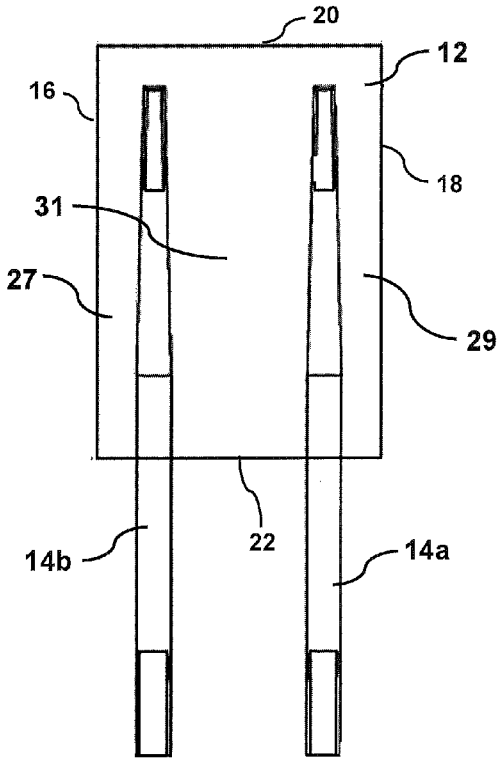
Fig. 1C
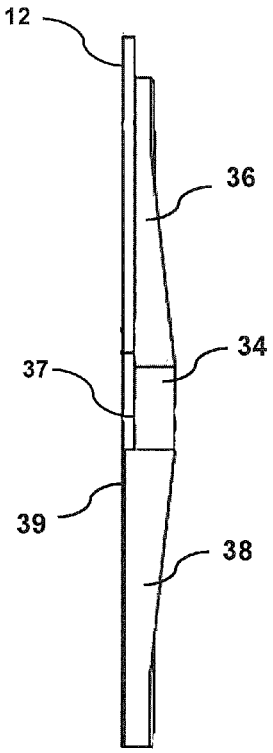
Fig. 1B

PRECAST INTEGRAL POST AND RETAINING WALL AND METHOD FOR INSTALLING SAME

CROSS REFERENCE TO RELATED APPLICATION

This application claims the benefit of U.S. Provisional Patent Application Ser. No. 61/842,807 filed Jul. 3, 2013, the entirety of which is hereby incorporated by reference as if fully set forth herein.

FIELD

The subject invention pertains generally to precast concrete retaining walls, and more particularly to a precast wall structure, and method of installing, having a face panel section and an integrally formed column extending therefrom.

BACKGROUND

In a conventional retaining wall design, one of the major design considerations is whether the existing terrain will require a cut into the existing ground or fill to create a higher elevation for a new structure such as a road or railway. There are several different retaining wall styles that fall into either deep or shallow foundation walls. In cut situations, typically a deep foundation wall such as a soldier pile retaining wall is preferred since the wall can be constructed with a minimal cut into the existing soil versus a shallow foundation wall such as a mechanically stabilized earth wall which requires a large excavation or cut into the existing ground for straps or ties which will then need to be backfilled with expensive select aggregate. These ties can also be a problem for future maintenance when there is limited space and the straps lie under a future road or railway.

Deep foundation systems generally provide an alternate solution which does not require tieback stabilizing features to oppose the lateral force of the soil. Thus, such systems can be highly advantageous where property lines or site conditions limit the horizontal footprint of the system. Such systems can also be especially useful where adverse soil conditions are near the surface or large loadings on the wall require more stable soil that is typically found at lower depths. Deep foundation systems typically consist of wall panels or laggings that span vertical columns (posts or piles) that can be either driven into the ground or embedded into concrete filled drilled holes. The columns can either cantilever out of the ground or can be anchored back with one or multiple tie rod(s) at various depths of the column. As the earth is filled along the back of the wall, the panels carry the load horizontally to the columns which extend vertically carrying the load deep into the ground and also into the anchors, when utilized.

As walls grow in height upwards of 15 feet, soldier pile walls become expensive due to the exponential nature of soldier pile design which requires huge steel rolled shapes to resist the large overturning moments due to the lateral forces from earth, wind, and/or vehicle surcharge amongst other forces. A composite design which ties the column to the face panel or lagging would reduce this cost. The installation of such known deep foundation post and panel retaining walls, however, is generally a time-consuming process that involves several steps, including for example, selecting a column spacing, determining the optimum length and diameter of the columns, embedding the columns into the holes and then subsequently returning to set the panels between the columns. In addition, the panels of such systems are typically designed as "simple spans" between the columns which must be lifted and moved into position and separately secured to the already installed exposed columns. Altogether, this process can be considerably labor-intensive and can increase the costs and installation time of retaining wall installation projects. Such disadvantages can in turn make deep foundation systems impractical and/or cost prohibitive.

Thus, in view of the foregoing, it would be extremely useful to have a deep foundation precast retaining wall system that can be easily installed and used in connection with a variety of locations and that is sufficiently robust to resist lateral pressures from the retained soil by utilizing multiple spans versus the conventional simple span. It would be further desirable if such structure could be economically fabricated and installed such that labor and material costs that are typically incurred in connection with retaining wall projects can be reduced, while also concealing the support columns for a cleaner aesthetic. From the following description, it will be recognized by persons of ordinary skill in the art that embodiments of the subject invention can provide such benefits as well as other objects, features of advantages.

BRIEF DESCRIPTION OF THE DRAWINGS

FIG. 1B is a side elevational view of the retaining wall structure of FIG. 1A.

FIG. 1C is a rear elevational view of the retaining wall structure of FIG. 1A.

FIG. 1D is a top plan view of the retaining wall structure of FIG. 1A.

DETAILED DESCRIPTION

Figure 1A:
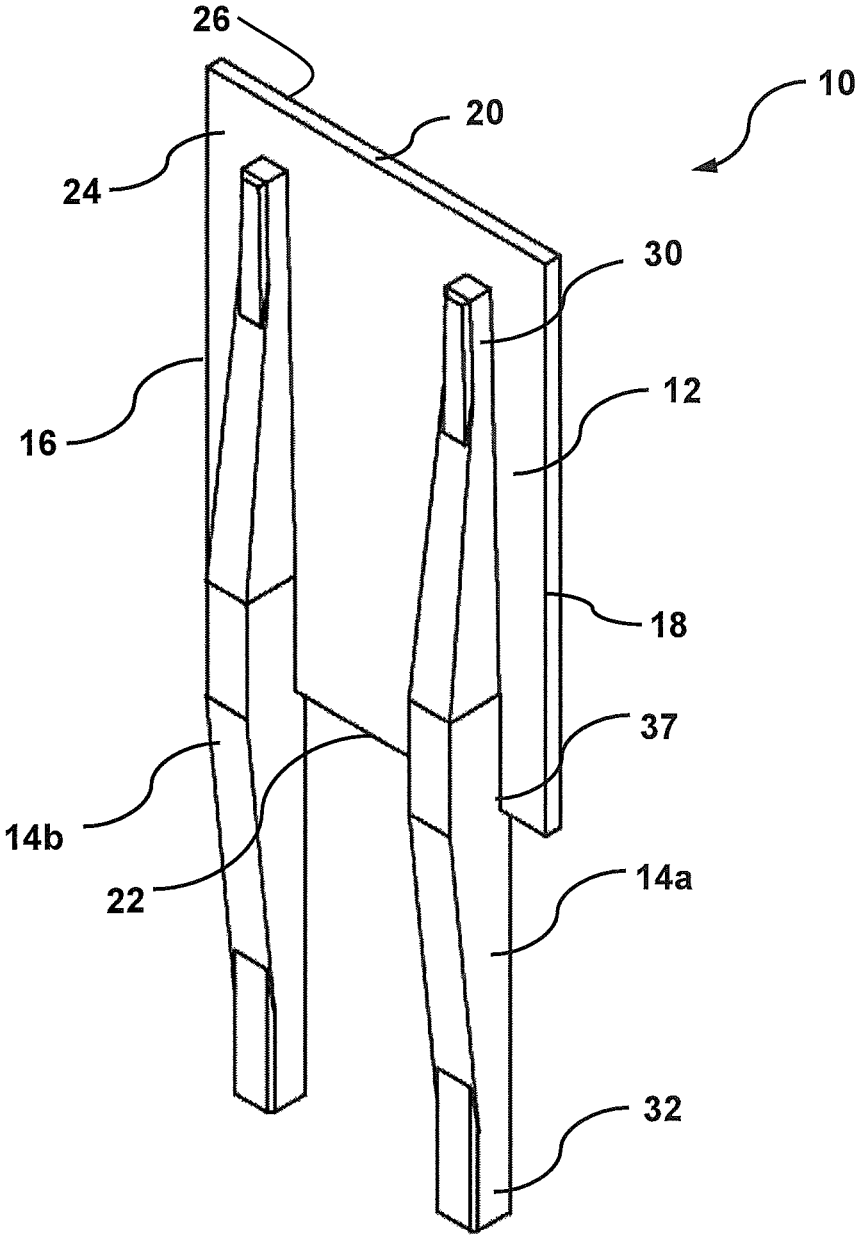
FIG. 1A is a rear perspective view of a retaining wall structure having precast support columns in accordance with embodiments presented herein.
Figure 2A:
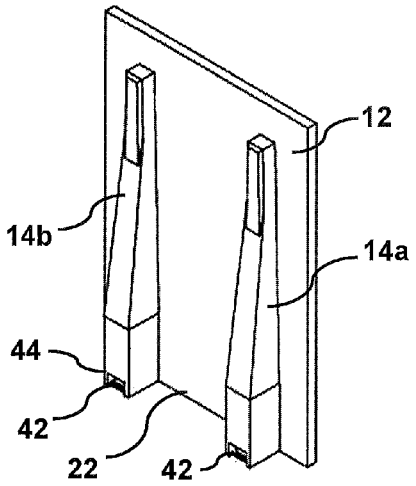
FIG. 2A is a rear perspective view of a retaining wall structure having precast support columns with baseplates in accordance with embodiments presented herein.
Figure 2B:
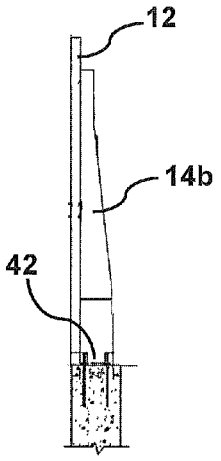
FIG. 2B is a side elevational view of the retaining wall structure of FIG. 2A secured to a concrete pier.
Figure 2C:
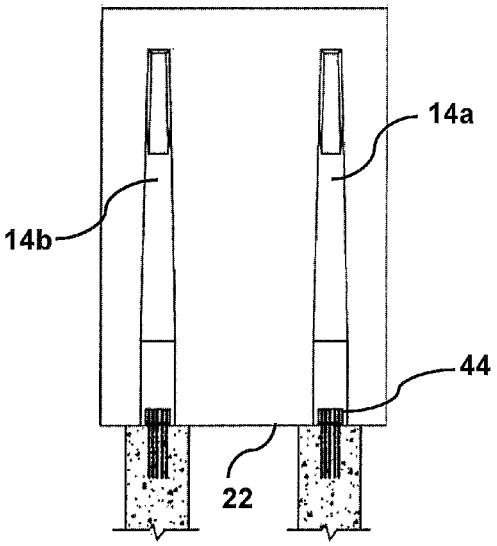
FIG. 2C is a rear elevational view of the retaining wall structure of FIG. 2A secured to concrete piers.
Figure 2D:
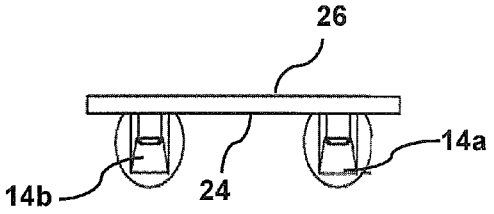
FIG. 2D is a top plan view of the retaining wall structure of FIG. 2A secured to concrete piers.

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

As presented herein, embodiments of the subject invention are directed to a precast post and panel retaining wall structure. According to such embodiments, the structure can be comprised of a pre-fabricated concrete face panel integrally formed with, or permanently joined to, at least one support column, post or leg that can be embedded into the ground or into a deep pier. The pre-fabricated connection between the face panel and column(s) can provide a number of benefits over traditional post and panel or lagging soldier pile retaining walls which feature multiple layered horizontal spans. In particular, the face panel can be a single continuous structure spanning between the column(s). The structure can thus have a T-shape formation in elevation to better resist shear stress. Such characteristics can provide a more structurally sound assembly while accomplishing the same goals as a deep foundation retaining wall structure. Moreover, the contiguous configuration of the face panel is a further benefit over traditional "simple spans" which are generally known to be an inefficient design. In particular, as pre-fabricated structures, embodiments presented herein can be installed much more rapidly and economically versus a traditional soldier pile walls with separate columns and layered panels or laggings.

Embodiments of the retaining wall structure presented herein additionally provides a cleaner, more refined aesthetic appearance over traditional retaining wall structures that typically have exposed columns. By contrast, the columns of the subject embodiments are concealed behind the face panel. Accordingly, the face panels are not broken up by unnatural looking vertical columns, thus providing the retaining wall with a more uniform and streamlined appearance.

With reference now to the figures, a retaining wall structure 10 is illustrated in accordance with embodiments presented herein. The structure 10 can feature a precast concrete face panel 12 and one or more elongated support columns 14*a*, 14*b* permanently joined to the face panel 12. The face panel 12 can be comprised of solid precast concrete or precast concrete having internal reinforcing members such as steel rebar. The face panel 12 can have two or more opposing edges 16, 18, including a top and bottom 20, 22, and first and second sides 24, 26 with a thickness therebetween.

During installation, column(s) 14*a*, 14*b* can be positioned substantially vertically to support face panel 12 in a substantially upright position. When installed, the bottom 22 of face panel 12 can be temporarily positioned in contact with the ground or a cast pier, deck or slab which can provide a bearing surface below the panel 12. Thus, face panel 12, in cooperation with column(s) 14*a*, 14*b* and the pier or foundation can form a barrier to retain backfilled soil or earth behind the structure 10 on the rear side 24 of the panel 12 having the column(s) 14*a*, 14*b*. Thus, backfilled material is prevented from sliding onto an area such as a roadway, railway or causeway that is adjacent the front side 26 of panel 12.

For exemplary purposes, the accompanying figures illustrate face panel 12 as having a flat rectangular shape on the order of 14 feet wide×20 feet high×7 inches thick. Persons of ordinary skill in the art, however, will understand that face. panel 12 can have alternate dimensions, shapes or configurations without departing from the scope of the subject invention. Panel 12, for instance, can have a curved or angled configuration for use as a corner retaining wall unit. In addition, face panel 12 may have more or fewer ends or corners, or ends or sides of varying lengths or shapes. The thickness of face panel 12 can additionally be substantially uniform as shown in figures, or can alternatively vary in thickness at different portions. Further, the ends of face panel 12 can alternatively have rounded, curved or angled edges or shear keys which can connect to adjacent face panels 12 or structures. In connecting adjacent structures, grout can be used on or around the edges or joints to improve the connection between adjacent pieces. In addition, joint tape/wrap can also be used to seal the vertical joint between adjacent faces.

In addition, although the sides 24, 26 of face panel 12 are shown in the drawings as having a smooth flat surface, they can alternatively feature depressions, ridges or other raised markings or patterns, without limitation. Embodiments of the subject invention can additionally feature a vehicle impact barrier formed at or near the top 20 of face panel 12. Moreover, exposed rebar can extend out of face panel 12 and be cast into the barrier on top of or behind structure 10. A pre-manufactured crash barrier, railing, safety device or structure can also be formed integrally with face panel 12 to protect the structure 10 from vehicle impacts and/or to protect operators or passengers of such vehicles.

Face panel 12 can be supported in an upright position by support column(s) 14*a*, 14*b* having various compositions or configurations. Generally, the support column(s) 14*a*, 14*b* can be rolled or cast steel shape beams and/or solid precast concrete and can have opposing ends 30, 32 with an elongated length portion 34 therebetween. Support column(s) 14*a*, 14*b* can additionally have an upper portion 36 permanently joined to face panel 12 and a lower portion 38 downwardly extending from the upper portion 36. The column(s) 14*a*, 14*b* can be a single continuous member or can alternatively be comprised of separate portions joined or spliced together. For example, the upper and lower portions 36, 38 of column(s) 14*a*, 14*b* can be separate pieces mechanically fastened or welded together with a shear key therebetween. In addition, where the columns 14*a*, 14*b* are precast, the columns 14*a*, 14*b* can extend below the face panel 12 and/or can further include a lip at the bottom end 32 to create a key when the pier is poured in order to resist lateral loads.

Support columns 14*a*, 14*b* can be straight or curved along their length and have any shape in cross section, including for example circular, rectangular, or steel beam shape without limitation. Support column(s) 14*a*, 14*b* can further be sized to any length or cross sectional area without departing from the scope of the subject invention. In addition, column(s) 14*a*, 14*b* can have a uniform cross-sectional area along their length, or the cross-sectional area can vary, such as for example, where column(s) 14*a*, 14*b* taper in size or diameter towards their respective ends 30, 32.

FIGS. 1A-1D and 2A-2D illustrate structures 10 having precast columns 14*a*, 14*b* integrally formed with face panel 12. The columns 14*a*, 14*b* can be fabricated with conventionally reinforced re-bar or pre-stressed concrete. Alternatively, the columns 14*a*, 14*b* can include a central steel beam surrounded by precast concrete. Columns 14*a*, 14*b* have a substantially rectangular shape in cross section with tapered ends 30, 32. The upper portion 36 of the support columns 14*a*, 14*b* can be integrally preformed with the rear side 24 of face panel 12 between the opposing edges 16, 18 of panel 12, and columns 14*a*, 14*b* can extend along the rear side 24 of face panel 12 toward the bottom 22 of the panel. Alternatively, the upper portion 36 of columns 14*a*, 14*b* can be entirely cast into the thickness of the face panel 12 and the columns 14*a*, 14*b* can extend out from the bottom 22 of the face panel 12.

In the embodiment illustrated in FIGS. 1A-1D, columns 14*a*, 14*b* can continue past the bottom 22 and downwardly extent away from face panel 12. During the installation of such structure 10, columns 14*a*, 14*b* can be driven into the ground or lowered into recesses in a concrete pier. The recesses can then be filled with concrete which can form around columns 14*a*, 14*b* to secure structure 10 in a fixed and upright position. According to the embodiment shown in FIGS. 1A-1D, lower portion 38 of columns 14*a*, 14*b* can downwardly extend from the bottom 22 of face panel 12 at a distance between 14-15 feet. Persons of ordinary skill in the art, however, will understand that columns 14*a*, 14*b* can be formed to any length and can extend away from face panel 12 at any distance without departing from the scope of the subject invention.

As shown in FIGS. 1A and 1C, columns 14*a*, 14*c* can have a thicker cross-sectional area at or around the bottom 22 of face panel 12 to provide added strength or support at this location which will likely be subject to the greatest lateral forces from the backfilled material. The cross-sectional area of columns 14*a*, 14*b* can additionally taper as they approach ends 30, 32. Upper portion 36 of columns 14*a*, 14*b* can additionally have a cutaway or notched section 37 such that the front side 26 of panel 12 is flush with the front side 39 of the lower portion 38 of columns 14*a*, 14*b* that are not covered by face panel 12.

FIGS. 2A-2D illustrate an additional embodiment having precast support columns 14*a*, 14*b*. As shown in these figures, support columns 14*a*, 14*b* can extend along a portion of the rear side 24 of face panel 12, but end at or around the bottom 22 of face panel 12. Thus, according to such embodiments, the vertical dimension (height) of face panel 12 can be equal to or greater than the length of columns 14*a*, 14*b*. The bottom end 32 of the columns 14*a*, 14*b* can have a baseplate 42 secured substantially perpendicular to the length of columns 14*a*, 14*b*. The baseplate 42 can be any size, shape or thickness and can include holes for receiving anchor bolts extending from concrete piers. In addition, the bottom end 32 of support columns 14*a*, 14*b* can additionally feature a notched area 44 with the baseplate secured to a central portion of support columns 14*a*, 14*b* between the respective sides such that the sides of columns 14*a*, 14*b* can downwardly extend around the sides of baseplate 42. Thus, as shown in FIGS. 2A-2D, baseplate 42 can be sized so that it does not extend outwardly from support columns 14*a*, 14*b* and is instead concealed by the side edges of support columns 14*a*, 14*b*.

FIGS. 3A-3B, 4A-C, 6A-6D and 7A-7D illustrate additional embodiments for a retaining wall structure 10. According to such embodiments, the retaining wall structure 10 can have support columns 14*a*, 14*b* comprised of rolled structural steel beams. Such beams can include, for example, I-beams, wide flange beams ("W-beams") or other beams having a substantially I- or H-shaped cross section, or beams having other cross sectional shapes, including for instance, Z-shape beams or joists, hollow structural sections, angle or structural channel beams without limitation. According to such embodiments, the steel support columns 14*a*, 14*b* can be permanently joined or formed to face panel 12 during precasting process of face panel 12. In joining the columns 14*a*, 14*b* with face panel 12, the upper portion 36 of support columns 14*a*, 14*b* can be secured to the rear side 24 of face panel 12 between the opposing edges 16, 18 of the panel 12, and the columns 14*a*, 14*b* can downwardly extend along the rear side 24 towards the bottom 22 of face panel 12. Alternatively, the upper portion 36 of the support columns 14*a*, 14*b* can be entirely cast into the thickness of face panel 12 and the columns 14*a*, 14*b* can extend out from the bottom 22 of the face panel 12.

Figure 3A:
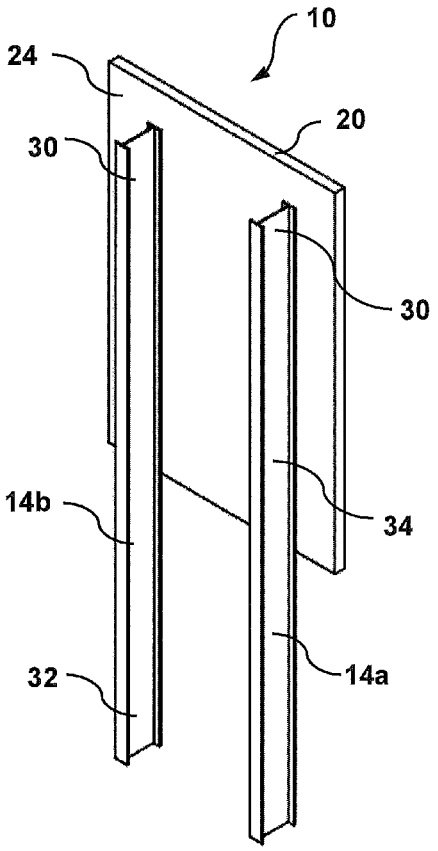
FIG. 3A is a rear perspective view of a retaining wall structure having structural steel support columns according to embodiments presented herein.
Figure 3B:
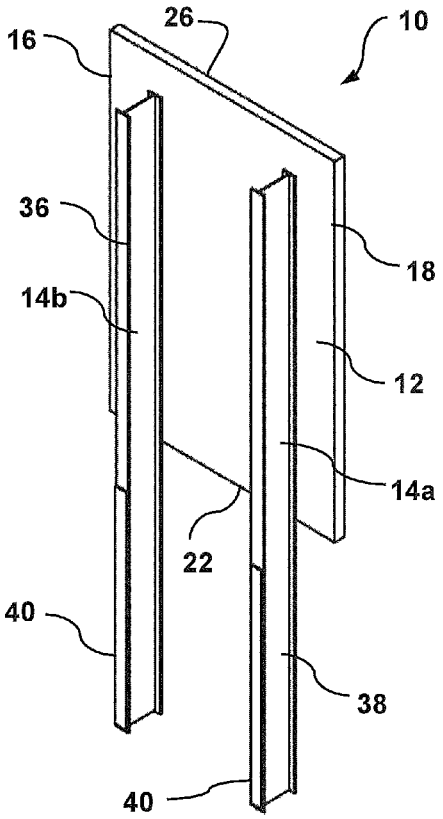
FIG. 3B is a rear perspective view of a retaining wall structure having structural steel support columns with cover plates according to embodiments presented herein.

FIGS. 3A-B and 4A-C illustrate structures 10 having columns 14*a*, 14*b* extending past the bottom 22 and downwardly from face panel 12. During the installation of such structures 10, columns 14*a*, 14*b* can be driven into the ground or lowered into recesses in a concrete pier. The recesses can then be filled with concrete to form around columns 14*a*, 14*b* to secure structure 10 in a fixed and upright position. According to the embodiment shown in FIGS. 3A-B, the lower portion 38 of columns 14*a*, 14*b* downwardly extend from the bottom 22 of face panel 12 at a distance between 14-15 feet. Persons of ordinary skill in the art, however, will understand that columns 14*a*, 14*b* can be formed to any length and can extend away from face panel 12 at any distance without departing from the scope of the subject invention. FIG. 3B additionally illustrates support columns 14*a*, 14*b* having cover plates 40 extending along a portion of their length. Cover plates 40 can be welded or mechanically secured to flanges of support columns 14*a*, 14*b* to provide additional structural support to columns 14*a*, 14*b* to prevent deformation, bending or deflection of the structural beams.

Figure 4A:
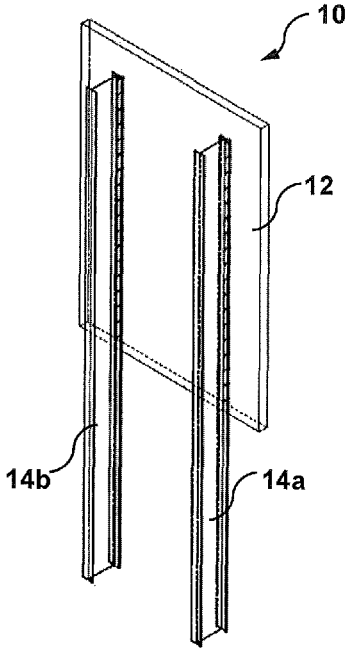
FIG. 4A is a rear perspective view partially in phantom of a retaining wall structure featuring steel support columns and headed anchor studs according to embodiments presented herein.
Figure 4B:
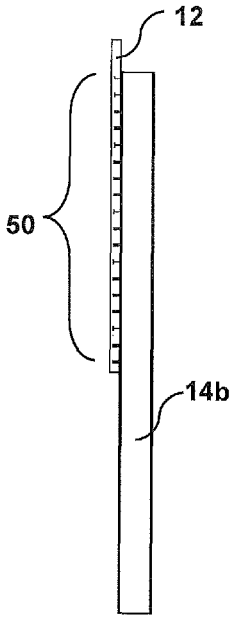
FIG. 4B is a sectional side elevational view of the retaining wall structure of FIG. 4A.
Figure 4C:
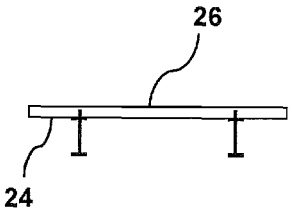
FIG. 4C is a top plan view of the retaining wall structure of FIG. 4A.
Figure 5:
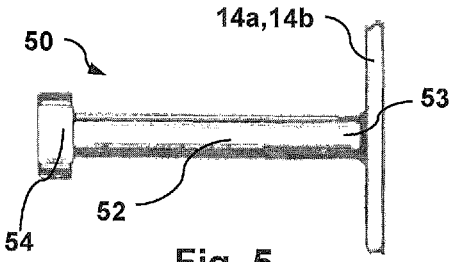
FIG. 5 is a detail side elevational view of a headed anchor stud according to embodiments presented herein.
Figure 6A:
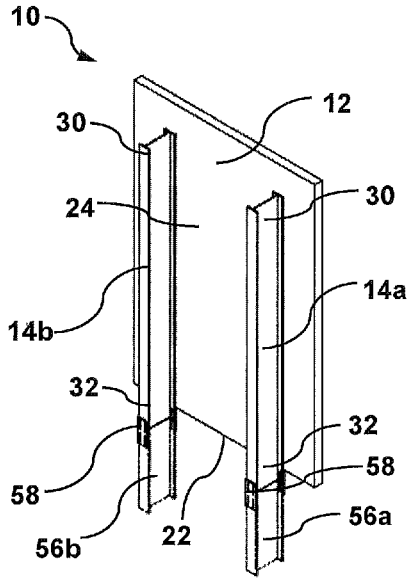
FIG. 6A is a perspective view of a retaining wall structure having spliced structural steel support columns.
Figure 6B:
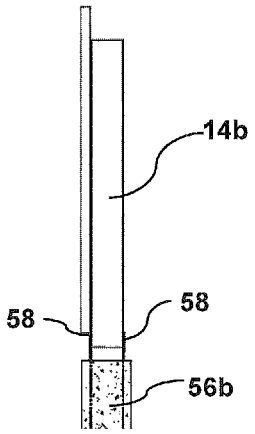
FIG. 6B is a side elevational view of the retaining wall structure of FIG. 6A spliced to a structural support beam cast in a pier.
Figure 6C:
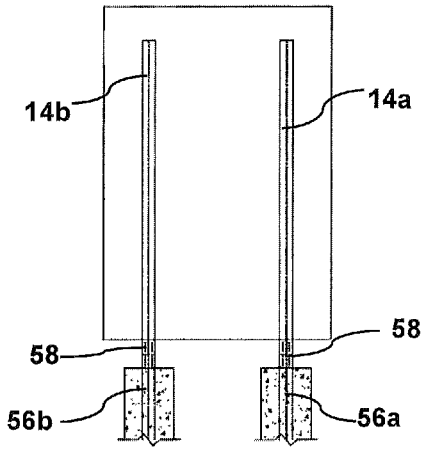
FIG. 6C is a rear elevational view of the retaining wall structure of FIG. 6A spliced to structural support beams cast in piers.
Figure 6D:
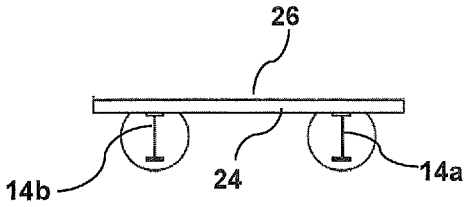
FIG. 6D is a top plan view of the retaining wall structure of FIG. 6A spliced to structural support beams cast in piers.
Figure 7A:
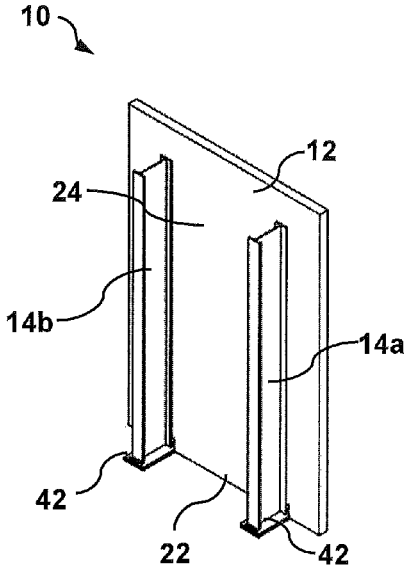
FIG. 7A is a perspective view of a retaining wall structure having structural steel support columns with baseplates in accordance with embodiments presented herein.
Figure 7B:
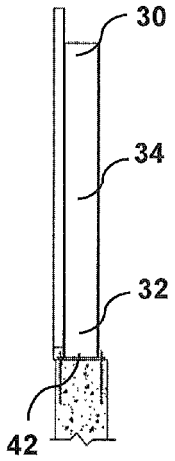
FIG. 7B is a side elevational view of the retaining wall structure of FIG. 7A secured to a concrete pier.
Figure 7C:
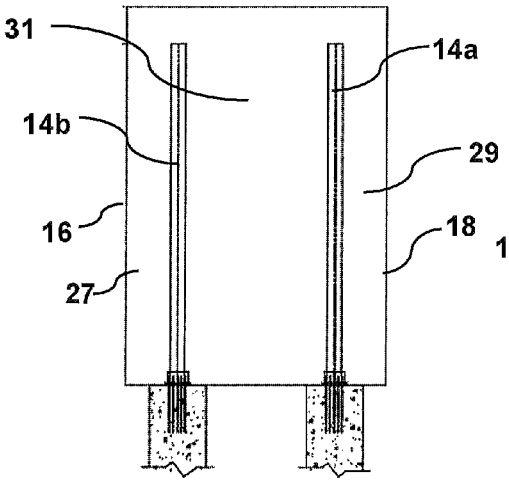
FIG. 7C is a rear elevational view of the retaining wall structure of FIG. 7A secured to concrete piers.
Figure 7D:
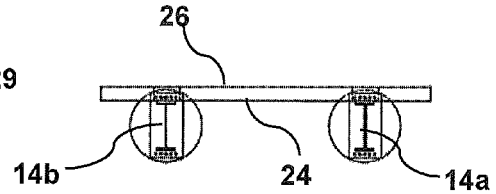
FIG. 7D is a top plan view of the retaining wall structure of FIG. 7A secured to concrete piers.

FIGS. 4A-4C illustrate that steel support columns 14*a*, 14*b* can additionally feature headed anchor studs 50 of the type illustrated in FIG. 5. As shown in FIG. 5, the headed anchor studs 50 can have an elongated shaft or body portion 52 and a head portion 54 having a larger diameter. The body 52 and/or head portions 54 can be cylindrical or have alternate cross-sectional shapes without departing from the scope of the subject invention.

As shown in FIGS. 4A-4C, the headed anchor studs 50 can extend substantially horizontally or perpendicular from the upper portion 36 of support columns 14*a*, 14*b* with the end 53 of the shaft 52 opposite the head portion 54 welded to the front flange 39 of support columns 14*a*, 14*b*. The anchor studs 50 can be located in series along the length of the upper portion 36 of support columns 14*a*, 14*b* and can extend into the rear side 24 of face panel 12. The anchor studs 50 can be permanently encased into face panel during the precast process. Thus, the concrete can bind around the headed anchor studs 50 to secure support columns 14*a*, 14*b* to panel 12.

It will be recognized by persons of ordinary skill in the art that embodiments of the subject invention can alternately include other types of studs, reinforcing bars or structural members projecting or extending from the upper portion 36 of support columns 14*a*, 14*b* into face panel 12. For example, if columns 14*a*, 14*b* are formed from precast concrete, they can have outwardly extending reinforcing bars extending from the precast exterior. When the face panel 12 is cast, the rebars can be positioned so that the concrete for the face panel 12 encases the rebar, making a permanent connection.

FIGS. 6A-6D illustrate an additional embodiment for a retaining wall structure 10 having structural steel support columns 14*a*, 14*b* that can be coupled to separate structural support beams 56*a*, 56*b* secured or embedded into a pier. According to such embodiment, the structural steel support columns 14*a*, 14*b* can extend along the rear side 24 of face plate 12 but can end at or around the bottom 22 of the face panel 12. During installation, the structure 10 can be temporarily lifted into position above the structural support beams 56*a*, 56*b* and support columns 14*a*, 14*b* and beams 56*a*, 56*b* can be respectively coupled via a sliced connection. The spliced connection can be made by placing a shim between support columns 14*a*, 14*b* and beams 56*a*, 56*b* and mechanically connecting or welding the bottom ends 32 of support columns 14*a*, 14*b* to the ends of the respective beams 56*a*, 56*b*. The connection can additionally include one or more splice plates 58 spanning the ends of the support columns 14*a*, 14*b* and beams 56*a*, 56*b*. The splice plates 58 can extend across the flanges or web sections of support columns 14*a*, 14*b* and beams 56*a*, 56*b* and be secured in place via mechanical fasteners or welded connection.

FIGS. 7A-7D illustrate an additional embodiment for a retaining wall structure 10 having structural steel support columns 14*a*, 14*b*. According to such embodiment, support columns 14*a*, 14*b* can extend along a portion of the rear side 24 of the face panel 12 but can end at or around the bottom 22 of the face panel 12. Thus, according to such embodiments, face panel 12 can extend along substantially the entire length of the columns 14*a*, 14*b*. The bottom end 32 of columns 14*a*, 14*b* can have a baseplate 42 secured substantially perpendicular to the length of the columns 14*a*, 14*b*. The baseplate 42 can be any size, shape or thickness and can include holes for receiving fasteners, such as for example anchor bolts, to secure structure 10 to a concrete pier or other foundation.

Although the figures reference herein illustrate retaining wall structure 10 having two spaced apart support columns 14*a*, 14*b*, the structure 10 can have more or fewer columns, without limitation. Regardless of the number of support columns, column(s) 14*a*, 14*b* can be spaced inwardly from the lateral edges 16, 18 of panel 10 such that the panel 10 has cantilevered end sections 27, 29 extending laterally outward from column(s) 14*a*, 14*b*. Where the structure 10 has multiple columns as shown in the figures, the structure 10 can additionally have a middle section 31 spanning between columns 14*a*, 14*b*.

Where the structure includes two support columns as illustrated in the accompanying figures, the columns 14*a*, 14*b* can be laterally outwardly spaced or offset an equal distance from a center of the face plate 12 and can further each be inwardly spaced an equal distance from the nearest lateral edge 16, 18. Thus, for exemplary purposes, the retaining wall structure 10 can, for example, have a face plate 12 having an overall length of 14 feet with a first column 14*a* inwardly spaced 3 feet on center from a first edge 16 of face plate 12 and a second column 14*b* inwardly spaced 3 feet on center from a second edge 18 of plate 12. According to this configuration, each column 14*a*, 14*b* can be offset 4 feet on center from the lateral center point of panel 12 and columns 14*a*, 14*b* can be spaced apart from each other at a distance of 8 feet on center.

If desired, columns 14*a*, 14*b* can alternatively be spaced at different distances from the nearest respective end or from the center of panel 12, and where the structure 10 includes more than two columns, the columns can be spaced apart from one another at a substantially equal distance or at different distances as required depending on the specific location or retaining wall application.

From the foregoing description, persons of ordinary skill in the art will recognize a number of advantages over prior deep foundation retaining wall structures. For instance, because the vertical support columns 14*a*, 14*b* can be hidden behind the horizontal face plate 12, the support columns 14*a*, 14*b* do not require as much material in locations away from the maximum design moment, especially when the column is precast. The result of such a configuration is that the materials are constructed more efficiently over simple span systems. Such a benefit is typically not possible or practical with columns of typical post and panel systems because it will likely cost more to try to fabricate a reduced sized steel support member and have to determine where to splice such members. Accordingly, typical post and panel designs typically have to utilize the same column shape for the full height of the face panel and additionally will have to use the same steel shape when that option is chosen.

Another added benefit with regard to the structure 10 described herein is aesthetic. For instance, the columns in a traditional post and panel retaining wall are generally exposed to view, whereas, in the system described herein, the columns are hidden and can give the wall a more uniform and streamlined appearance. In particular, the face panels are not broken up by unnatural looking vertical columns.

In addition, the support columns 14*a*, 14*b* of the subject retaining wall structure 10 don't protrude or extend away from the front side 26 of the face panel 10 and thus will not cause any kind of snag point for vehicular or pedestrian traffic. In addition, there is generally not a limit on the height or width of the face panels 12 that can be used in connection with embodiments disclosed herein. Accordingly, persons of ordinary skill in the art will understand that the size and shape of any piece of the assembly disclosed herein can be modified without departing from the novel scope of the subject invention. In addition, pieces of the assembly can further be made to custom sizes depending on the requirements of the project.

The retaining wall structure 10 disclosed herein can further incorporate additional support structures if required. In particular, helical anchors (not shown in the figures) can be post-installed through holes in the upper portion 36 of support columns 14*a*, 14*b* or face panel 12 back into the high side of the backfilled earth after backfilling the structure. Alternatively, tie rods (not shown) can be used to anchor back to either a dead-man or sheet piling can be utilized during the backfilling process for added strength or stability. The assembly can additionally incorporate MSE style straps extending from the upper portion 36 of the support columns 14*a*, 14*b* or face panel 12 back into the high side fill during the backfilling process.

Figure 8:
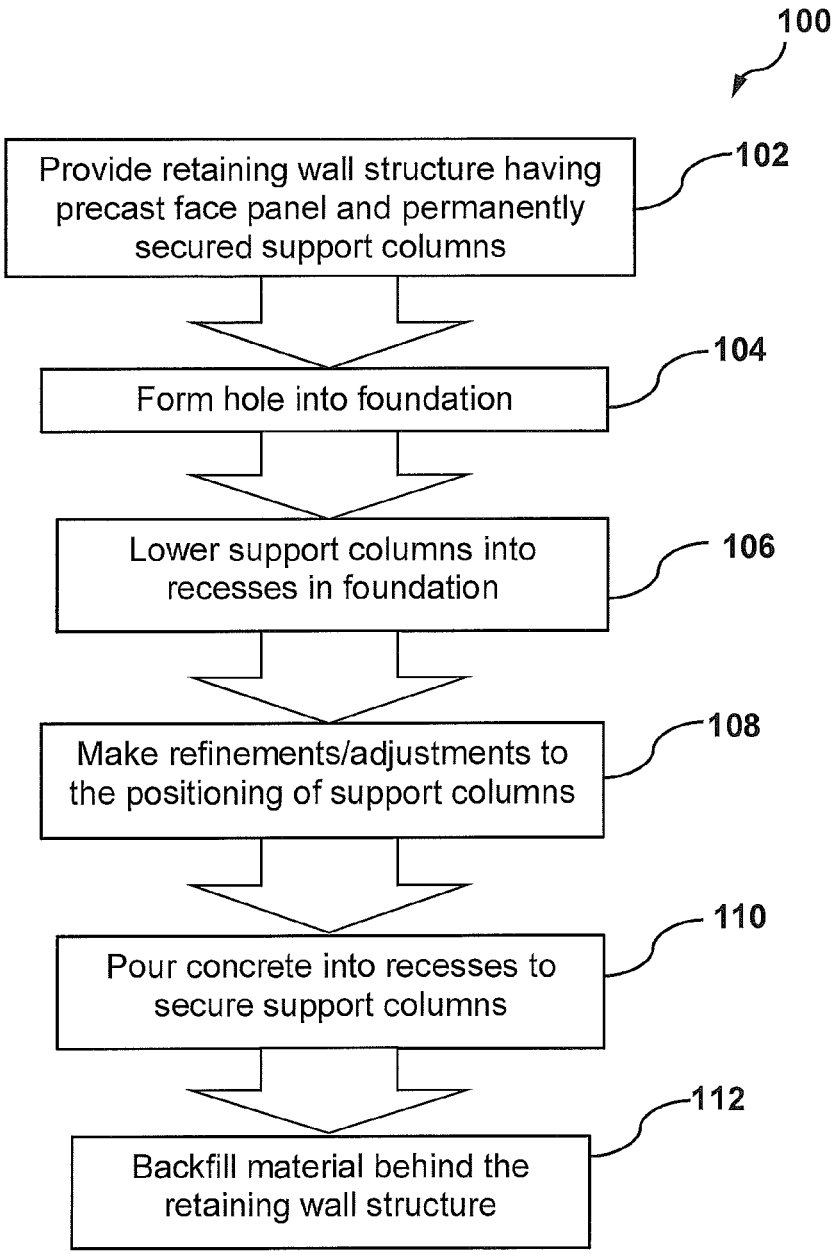
FIG. 8 is a flowchart illustrating a process for installing a retaining wall structure in accordance with embodiments presented herein.

FIG. 8 is a flowchart illustrating a method 100 for installing a retaining wall in accordance with embodiments presented herein. According to such method 100, a retaining wall structure can be provided 102 having a precast face panel permanently secured to at least one elongated support column extending therefrom. At least one hole or recess can be formed, dug, drilled or bored 104 into the foundation upon which the structure is to be located. The foundation can include, for example, a natural ground surface, a road surface or pavement or a cast platform, deck or slab. The depth of the hole or recess can vary depending on the particular application and size/configuration of the retaining wall.

The structure can be erected on the foundation by lowering or inserting 106 the support columns into the hole and by making 108 any refinements to adjust and/or correct the positioning of the structure on the foundation. Such refinements can include for example, adding a shim material to level or adjust the fit of the support columns within the holes or recesses. The structure can be secured to the foundation by pouring or introducing 110 concrete into the holes or recesses upon which the support columns were lowered. The concrete can be introduced into the holes by any known process and can fill the recesses. Over time, the concrete can dry to form a ridged composite binding the support column within the recess. Alternatively, the support columns can be driven into the ground and secured by existing soil or earth surrounding the columns. Once the structure is erected, the soil, earth or retained material can be backfilled 112 as needed and allowed to accumulate behind the face panel on the side of the support columns.

Figure 9:
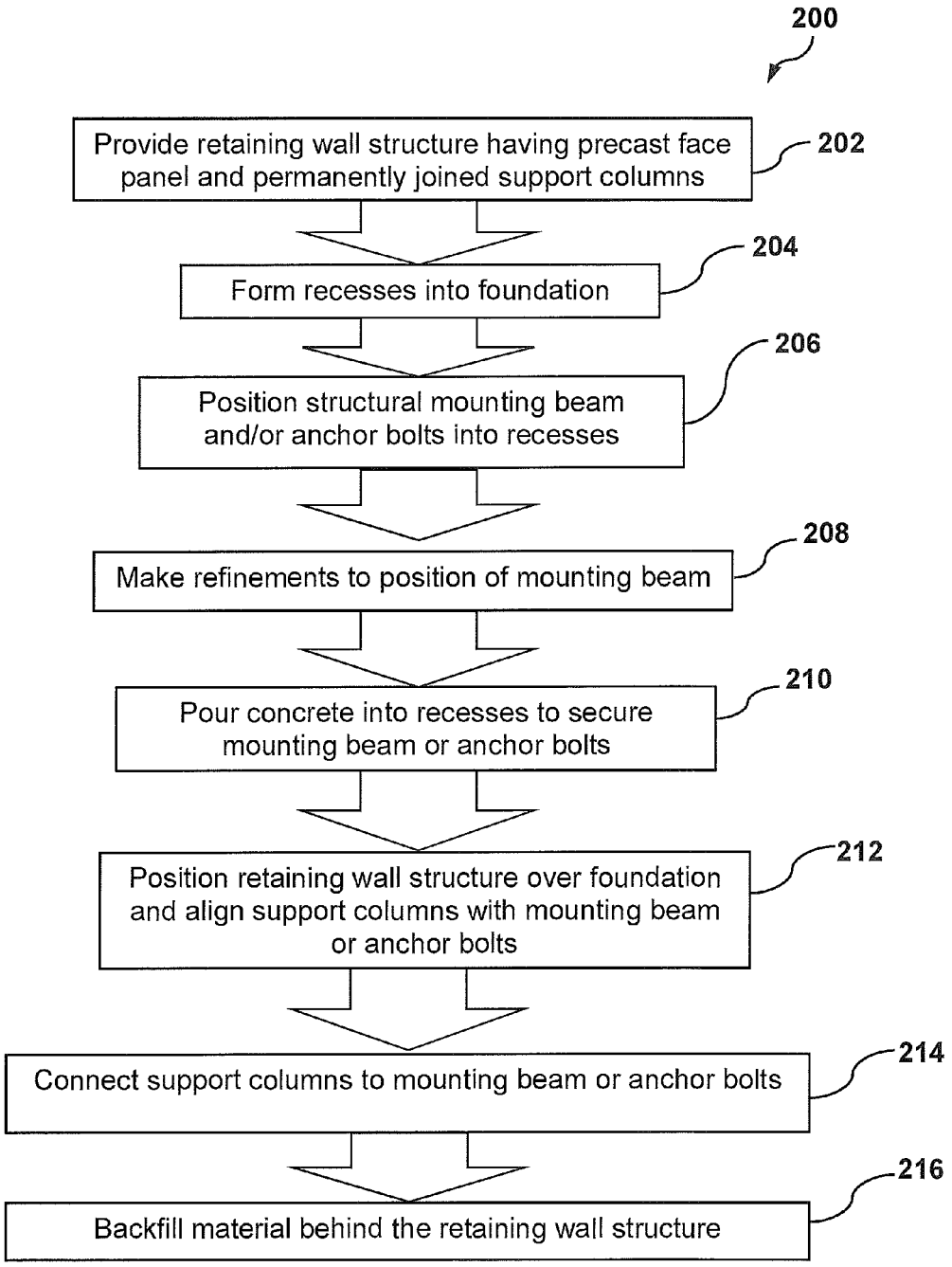
FIG. 9 is a flowchart illustrating an additional process for installing a retaining wall structure in accordance with embodiments presented herein.

FIG. 9 is a flowchart illustrating another method 200 for installing a retaining wall in accordance with embodiments presented herein. According to such method 200, a retaining wall structure can be provided 202 having a precast face panel permanently joined with at least one elongated support column extending along the rear side of the panel. At least one hole or recess can be formed, dug, drilled or bored 204 into the foundation upon which the structure is to be located. The foundation can include, for example, a natural ground surface, a road surface or pavement or a cast platform, deck or slab. The depth of the hole or recess can vary depending on the particular application and size/configuration of the retaining wall.

A structural mounting beam can be positioned 206 substantially vertically into the recess or hole such that a portion of the beam extends out of the recess and any refinements to adjust and/or correct the positioning of the mounting beam can be instituted 208. Such refinements can include for example, adding a shim material to level or adjust the fit of the mounting beam within the holes or recesses. The mounting beam can be secured to the foundation by pouring or introducing 210 concrete into the holes or recesses upon which the mounting beams are positioned. The concrete can fill the recesses and over time will dry to form a ridged composite binding the mounting beam within the recess or concrete pier.

The retaining wall structure can be erected by positioning 212 the structure over the foundation so that the support columns are aligned with the mounting beams. The support columns and mounting beams can be connected 214 at their respective free ends by via spliced connection. The spliced connection can include adding a shim between the structures, mechanically connecting or welding the ends of the structures together and/or securing one or more slice plates across the ends of the structures along the flanges or web. Once erected, the soil, earth or retained material can be backfilled 216 as needed and allowed to accumulate behind the face panel on the side of the support columns.

As an alternative, the retaining wall structure can be provided 202 with a base plate at the bottom end of the support columns. Anchor bolts can be placed 206 into the recess or hole and can be secured in place by pouring or introducing 210 concrete into the holes. The retaining wall structure can then be positioned 212 over the foundation so that the ends of the anchor bolts extend through holes in the base plate. The baseplate and anchor bolts can then be connected 214 with fasteners to secure the retaining wall structure in a fixed upright position and once erected, the soil, earth or retained material can be backfilled 216 as needed and allowed to accumulate behind the face panel on the side of the support columns.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be added to, or removed from the described embodiments.

What is claimed is:

1. A method for installing a retaining wall comprising:

providing a one-piece retaining wall structure comprising a precast face panel and elongated support columns permanently joined together before commencement of installation of the retaining wall, the face panel having a top and bottom, opposing end edges and a first side and second side having a thickness therebetween, the elongated support columns extending along the first side of the face panel between the opposing end edges, the columns having first and second ends and an elongated body therebetween;

forming a hole into a foundation upon which the structure is to be installed, the hole having a cross-sectional area sized to accommodate at least one structural beam and a depth sufficient to receive only a portion of a length of the structural beam;

inserting the structural beam into the hole in a vertical orientation, the beam having an exposed end upwardly extending out of the hole;

introducing concrete into the hole, the concrete hardening around the beam to permanently secure the beam in a fixed position within the hole;

installing the one-piece retaining wall structure to the foundation by positioning the retaining wall structure over the foundation and aligning the support columns with the structural beams;

connecting the second end of the support columns to the exposed ends of the structural beams, and backfilling soil behind the retaining wall structure.

2. A method for installing a retaining wall comprising:

providing a one-piece retaining wall structure comprising a precast face panel and elongated support columns permanently joined together before commencement of installation of the retaining wall, the face panel having a top and bottom, opposing end edges and a first side and second side having a thickness therebetween, the elongated support columns extending along the first side of the face panel between the opposing end edges, the columns having first and second ends and an elongated body therebetween; the second ends of the elongated support columns having a planar baseplate affixed thereto, the baseplate being perpendicular to the support column;

forming a hole into a foundation upon which the structure is to be installed;

inserting anchor bolts into the hole in a vertical orientation, the anchor bolts having exposed ends upwardly extending out of the hole;

introducing concrete into the hole, the concrete binding around the anchor bolts to permanently secure the anchor bolts in a fixed position within the hole;

installing the one-piece retaining wall structure to the foundation by positioning the retaining wall structure over the foundation and aligning the support columns with the anchor bolts;

securing the base plate of the support columns to the anchor bolts, and backfilling soil behind the retaining wall structure.

* * * * *